US011428148B2

(12) United States Patent
Dong et al.

(10) Patent No.: US 11,428,148 B2
(45) Date of Patent: Aug. 30, 2022

(54) TANK USED IN ENGINE COOLING SYSTEM, ENGINE COOLING SYSTEM, AND WORK MACHINE

(71) Applicant: Caterpillar SARL, Geneva (CH)

(72) Inventors: Li Dong, Wuxi (CN); Guoping Tian, Wuxi (CN); Gengxin Liu, Wuxi (CN); Kesheng Xu, Wuxi (CN)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 17/296,536

(22) PCT Filed: Nov. 20, 2019

(86) PCT No.: PCT/EP2019/025408
§ 371 (c)(1),
(2) Date: May 24, 2021

(87) PCT Pub. No.: WO2020/104063
PCT Pub. Date: May 28, 2020

(65) Prior Publication Data

US 2022/0025809 A1 Jan. 27, 2022

(30) Foreign Application Priority Data

Nov. 22, 2018 (CN) ..... 201811398780.4

(51) Int. Cl.
*F01P 11/04* (2006.01)
*F01P 3/02* (2006.01)
(Continued)

(52) U.S. Cl.
CPC ..... *F01P 11/028* (2013.01); *F01P 5/10* (2013.01); *F01P 11/029* (2013.01); *F01P 11/04* (2013.01); *F02F 1/16* (2013.01)

(58) Field of Classification Search
CPC ..... F01P 11/028; F01P 11/029; F01P 3/02
See application file for complete search history.

(56) References Cited

U.S. PATENT DOCUMENTS 3,752,132 A * 8/1973 Bentz ..... F01P 11/02 123/41.1
4,422,502 A 12/1983 Villeval
(Continued)

FOREIGN PATENT DOCUMENTS

CN 101749966 A 6/2010
CN 202970886 U 6/2013
(Continued)

OTHER PUBLICATIONS

International Search Report related to Application No. PCT/EP2019/025408; reported on Mar. 30, 2020.
(Continued)

*Primary Examiner* — Long T Tran
(74) *Attorney, Agent, or Firm* — Nicole M. Bulman; Von Briesen & Roper, s.c.

(57) ABSTRACT

The invention relates to a tank used in an engine cooling system, the engine cooling system, and a work machine. The tank includes a housing and a partition which dividing the housing into an exhaust tank and an expansion tank which are sealed from each other. The exhaust tank includes a first connecting pipe and a second connecting pipe, the first connecting pipe being adapted to be fluidly connected to an engine cylinder jacket of the engine cooling system to introduce coolant into the exhaust tank, and the second connecting pipe being adapted to be fluidly connected to a heat exchanger of the engine cooling system to discharge the coolant into the heat exchanger. The expansion tank includes a third connecting pipe adapted to be fluidly connected to the engine cooling system. The tank further includes a guiding tube having a first end in communication with the exhaust tank, and a second end arranged in the expansion tank, so that gas contained in the coolant flowing through the exhaust tank is exported into the expansion tank through the guiding tube. The exhaust tank enables the gas in the coolant to be
(Continued)

separated before entering the heat exchanger, and the thermal stress impact to the heat exchanger is reduced.

13 Claims, 6 Drawing Sheets

(51) Int. Cl.
*F01P 11/02* (2006.01)
*F01P 5/10* (2006.01)
*F02F 1/16* (2006.01)

(56) References Cited

U.S. PATENT DOCUMENTS 4,480,598 A * 11/1984 Berrigan ..... F01P 11/029 123/41.27
4,510,893 A * 4/1985 Schweiger ..... F01P 11/0247 123/41.1
4,738,228 A * 4/1988 Jenz ..... F01P 11/029 123/41.27
4,739,730 A * 4/1988 Jenz ..... F01P 11/029 73/49.3
5,329,889 A * 7/1994 Caldwell ..... F01P 11/029 165/104.32
5,456,218 A 10/1995 Theorell
6,216,646 B1 * 4/2001 Smith ..... F01P 11/029 165/104.32
2008/0190385 A1 8/2008 Bangert et al.
2014/0042234 A1 * 2/2014 Moser ..... B60H 1/025 237/12.4
2016/0186645 A1 * 6/2016 Rollinger ..... F01P 7/16 701/102
2016/0222869 A1 * 8/2016 Nishiguchi ..... F01P 11/029
2017/0275846 A1 * 9/2017 Nishiguchi ..... E02F 9/0866

FOREIGN PATENT DOCUMENTS

CN 205117481 U 3/2016
CN 106812593 A 6/2017
DE 29914581 U1 10/1999
EP 0768452 A1 4/1997
EP 0887523 A2 12/1998
EP 2762696 A1 8/2017
RU 2187664 C1 8/2002

OTHER PUBLICATIONS

Chinese Search Report related to Application No. 2018113987804; reported on Nov. 22, 2018.

* cited by examiner

TANK USED IN ENGINE COOLING SYSTEM, ENGINE COOLING SYSTEM, AND WORK MACHINE

This patent application is a 35 USC § 371 U.S. national stage of International Application No. PCT/EP2019/025408 filed on Nov. 20, 2019, which claims the benefit and priority of Chinese Application No, 201811398780.4 filed on Nov. 22, 2018, the disclosures of which are incorporated in their entirety by reference herein.

TECHNICAL FIELD

The present invention relates to a tank used in an engine cooling system, the engine cooling system, and a work machine comprising the tank.

BACKGROUND

A work machine is generally provided with an engine cooling system to prevent the engine from overheating, which is particularly important for heavy machinery (such as loaders) where the engine has a high compression ratio and generates a large amount of heat.

A coolant pump is provided in the engine cooling system to drive a coolant to flow through the cooling system. An engine cylinder jacket is provided outside an engine cylinder, and the coolant flows through the engine cylinder jacket under the action of the pump to take away the heat generated by the engine during operation. Thereafter the high-temperature coolant enters into the heat exchanger where it is cooled, then the cooled liquid is again pumped into the engine cylinder jacket by the pump, thus circulation of the cooling system is achieved.

An expansion water tank/expansion tank is generally provided in the engine cooling system, which is mainly used for receiving vapour of the coolant and replenishing coolant during the operation of the engine cooling system, so that the coolant in the cooling system has a receiving room when it is heated and expands, thereby solving the overflow problem that may occur during circulation of the coolant. When the coolant diminishes or contracts, the cooling system can be replenished by the coolant from the expansion tank. The expansion tank can be connected to the water tank of the heat exchanger or to the suction port of the coolant pump.

During operation of the engine, gas bubbles may be formed, in the case that the high-pressure combustion gases in the combustion chamber of the engine flee into the engine cylinder jacket. Also, gas bubbles may be entrained when the coolant is filled into the expansion tank. These bubbles are mixed in the coolant to cause thermal stress impact to the cooling pipes of the heat exchanger, resulting in a decrease in heat exchange performance. In addition, these bubbles may cause a partial vacuum in the engine cooling system, impacting the liquid supply capacity of the pump of the cooling system, so that the heat generated by the engine during operation cannot be fully taken away by the coolant in time and the engine may be overheated.

Therefore, an urgent problem to be solved in the art is to effectively remove the gas bubbles in the coolant, especially to remove the gas bubbles in the coolant after it flows out of the engine cylinder jacket and before it enters into the heat exchanger, so as to reduce the thermal stress impact to the heat exchanger.

The object of the present invention is to solve the above problems and/or other defects existing in the prior art.

SUMMARY OF THE INVENTION

The present invention provides a tank for an engine cooling system. The tank includes a housing and a partition dividing the housing into an exhaust tank and an expansion tank which are sealed from each other. The exhaust tank includes a first connecting pipe and a second connecting pipe, the first connecting pipe being adapted to be fluidly connected to an engine cylinder jacket of the engine cooling system to introduce a coolant into the exhaust tank, and the second connecting pipe being adapted to be fluidly connected to a heat exchanger of the engine cooling system to discharge the coolant into the heat exchanger. The expansion tank includes a third connecting pipe adapted to be fluidly connected to the engine cooling system. The tank further includes a guiding tube having a first end in communication with the exhaust tank, and a second end arranged in the expansion tank, so that gas contained in the coolant flowing through the exhaust tank is vent into the expansion tank through the guiding tube.

The present invention further provides an exhaust tank for an engine cooling system. The exhaust tank includes a casing through which the coolant flows, a first connecting pipe disposed on the casing and adapted to be fluidly connected to an engine cylinder jacket of the engine cooling system to introduce a coolant into the exhaust tank, and a second connecting pipe disposed on the casing and adapted to be fluidly connected to a heat exchanger of the engine cooling system to discharge the coolant into the heat exchanger; and a guiding tube having a first end in communication with the exhaust tank and a second end adapted to be connected to the expansion tank of the engine cooling system, so that gas contained in the coolant flowing through the exhaust tank is vent into the expansion tank through the guiding tube.

The present invention also provides an engine cooling system that includes a tank or an exhaust tank as described above.

The present invention further provides a work machine that includes the engine cooling system as described above.

Advantages of the present invention at least lie in that: the exhaust tank provided between the engine cylinder jacket and the heat exchanger enables the gas in the coolant to be separated before entering into the heat exchanger, which reduces the impact to the heat exchanger by the entrained gas in the coolant, and avoids affecting the heat dissipation. Further, the exhaust tank may be integrated into the expansion tank of the engine cooling system, which facilitates installation, transportation, storage, and the like. Still further, by providing the exhaust tank in a circulation path of the engine cooling system, the coolant is separated from gas repeatedly, so that the gas in the coolant becomes less and less, thus the coolant is purged. Still further, by providing a protrusion in the exhaust tank, the flow of the coolant is slowed down, so that the gas is separated from the coolant more effectively. Furthermore, the temperature of the coolant is lowered by an auxiliary cooling pipe outside the exhaust tank, which promotes heat exchange of the coolant and reduces the impact of the high-temperature coolant on the heat exchanger.

DETAILED DESCRIPTION

The technical solutions of the present invention will be further described in detail below in conjunction with the embodiments and the accompanying drawings. The description of the embodiments of the present invention with reference to the accompanying drawings intends to illustrate the general inventive concept of the invention, and should not be construed as a limitation to the invention.

In addition, in the detailed description below, for ease of interpretation, many specific details are described to provide a comprehensive understanding of the disclosed embodiments. Obviously, however, one or more embodiments may also be implemented without these specific details. In other cases, well-known structures and devices are illustrated schematically to simplify the drawings.

Figure 11:
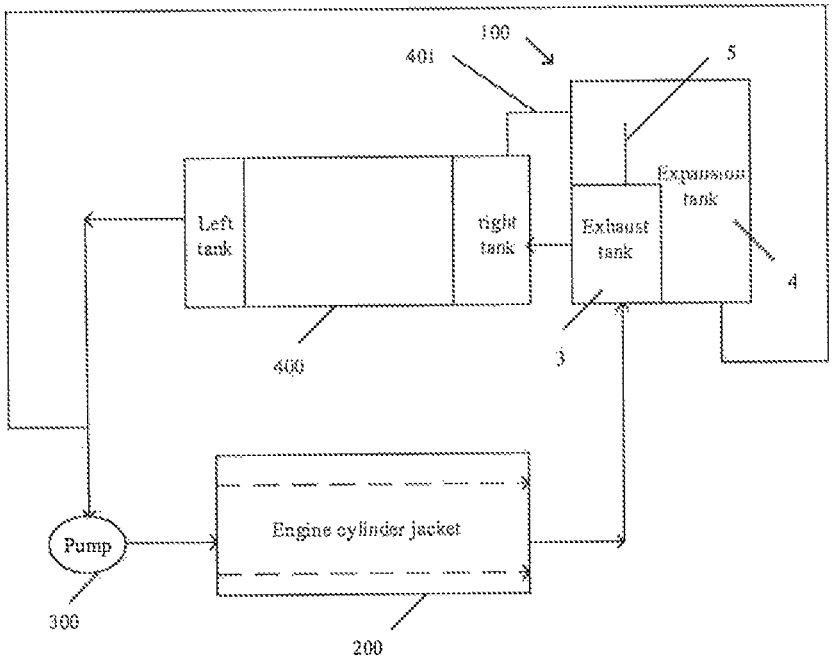
FIG. 11 is a schematic principle diagram of an engine cooling system according to an exemplary embodiment in the present invention.

FIG. 11 shows a schematic principle diagram of an exemplary engine cooling system. Coolant is circulated in the engine cooling system under the action of a pump 300. The coolant is pumped into the engine cylinder jacket 200, where heat-exchange occurs between the coolant and the high-temperature engine cylinder, so that temperature of the coolant rises. The high-temperature coolant flows into the heat exchanger 400, where the coolant is cooled, and the cooled liquid is pumped into the engine cylinder jacket again to achieve circulation in the cooling system. According to an exemplary embodiment of the present invention, an exhaust tank 3 is disposed in the engine cooling system between the engine cylinder jacket from which the high-temperature coolant flows out and the heat exchanger 400 to which the coolant flows. The coolant flows into the exhaust tank 3, where the gas in the coolant is separated from the coolant. In addition, the exhaust tank 3 also has a certain cooling effect on the coolant. In this way, thermal stress impact on the pipe assembly of the heat exchanger caused by the entrained gas in the coolant is reduced, and reduction of the cooling effect due to gas bubbles is also avoided.

It will be understood by those skilled in the art that the above-described gas-exhausting and cooling functions can be realized as long as the exhaust tank 3 is disposed between the engine cylinder jacket 200 and the heat exchanger 400. The exhaust tank 3 may be integrated with an expansion tank 4 of the engine cooling system (as illustrated in the embodiment shown in FIGS. 1-9) or disposed in a circulation path of the cooling system as a separate tank (i.e. separated from the expansion tank, as illustrated in the embodiment shown in FIG. 10).

Figure 1:
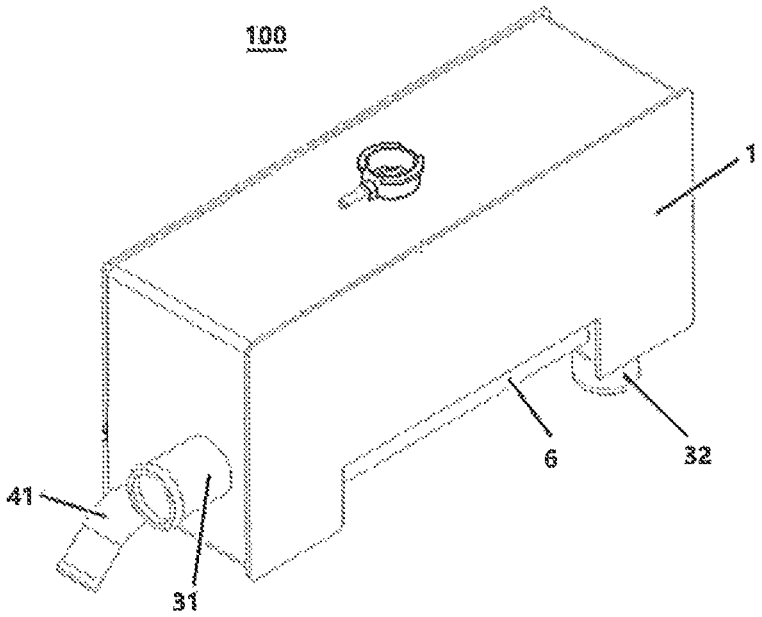
FIG. 1 is a perspective view of a tank according to an exemplary embodiment of the present invention.
Figure 2:
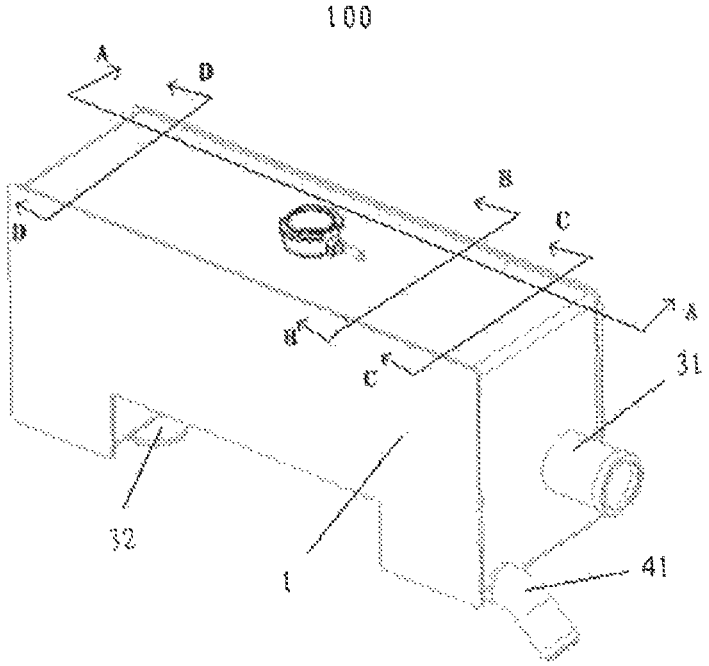
FIG. 2 is another perspective view of the tank as shown in FIG. 1.
Figure 3:
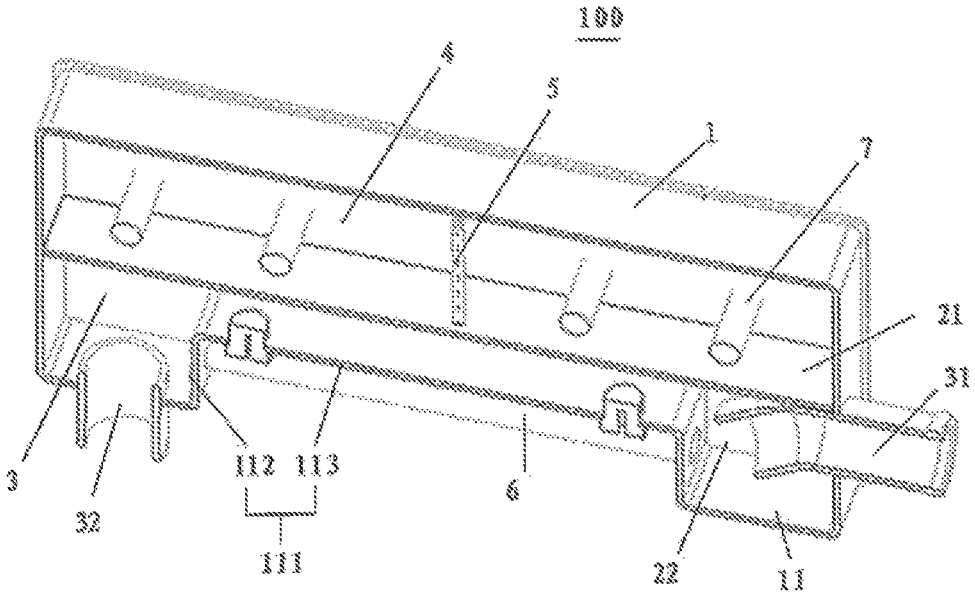
FIG. 3 is a cross-sectional perspective view of the tank shown in FIG. 2 taken along line A-A.
Figure 4:
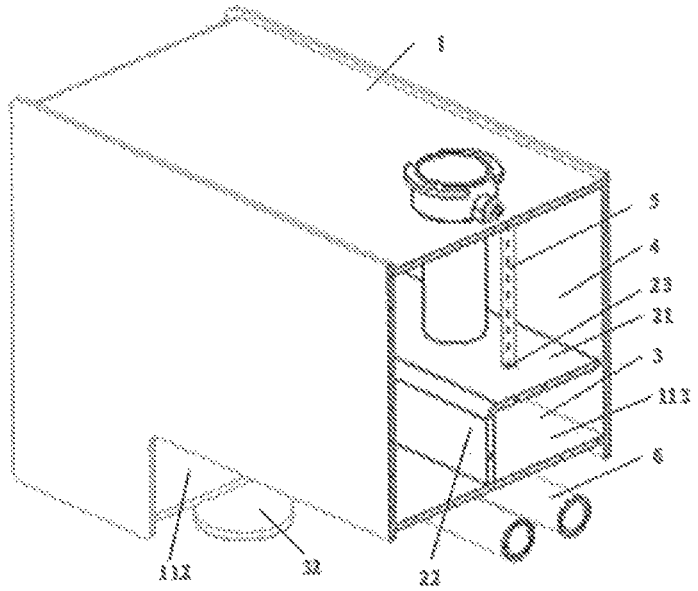
FIG. 4 is a cross-sectional perspective view of the tank as shown in FIG. 2 taken along line B-B.
Figure 5:
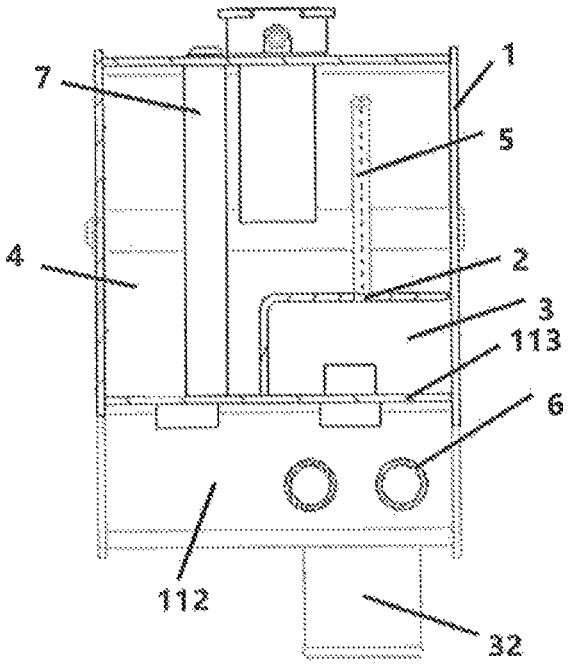
FIG. 5 is a cross-sectional plan view of the tank as shown in FIG. 2 taken along line B-B.
Figure 6:
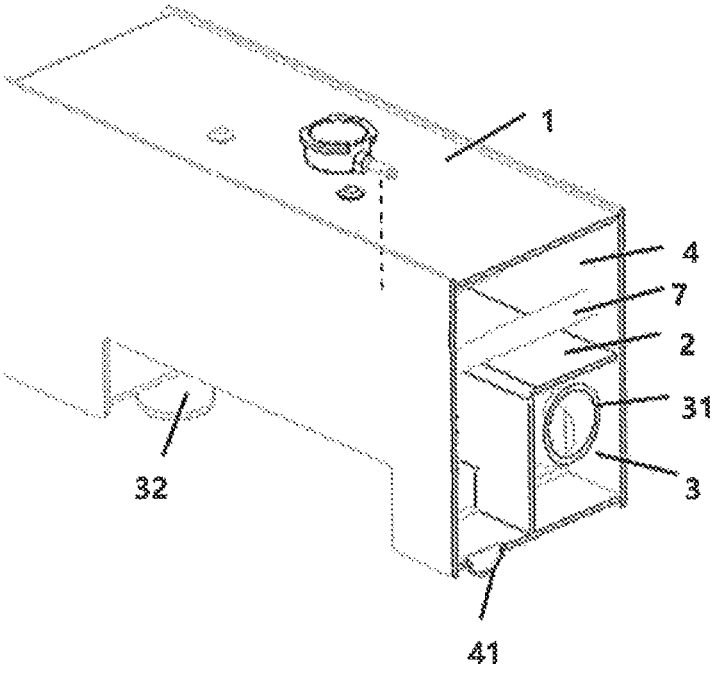
FIG. 6 is a cross-sectional perspective view of the tank shown in FIG. 2 taken along line C-C.
Figure 7:
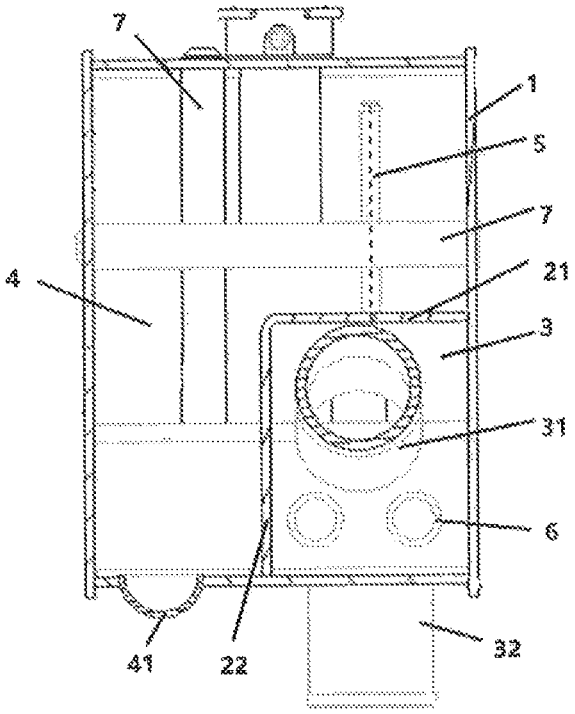
FIG. 7 is a cross-sectional plan view of the tank as shown in FIG. 2 taken along line C-C.
Figure 8:
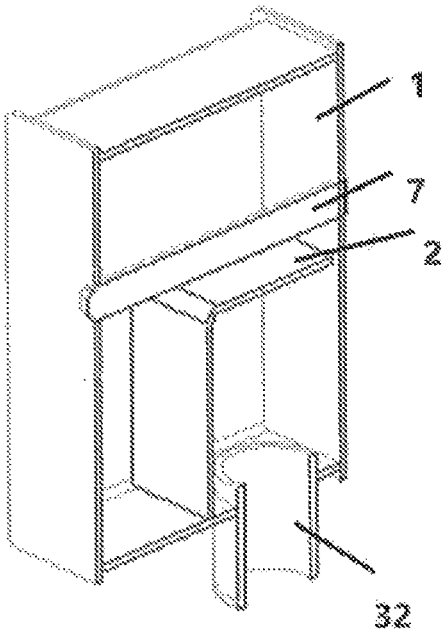
FIG. 8 is a cross-sectional perspective view of the tank as shown in FIG. 2 taken along line D-D.
Figure 9:
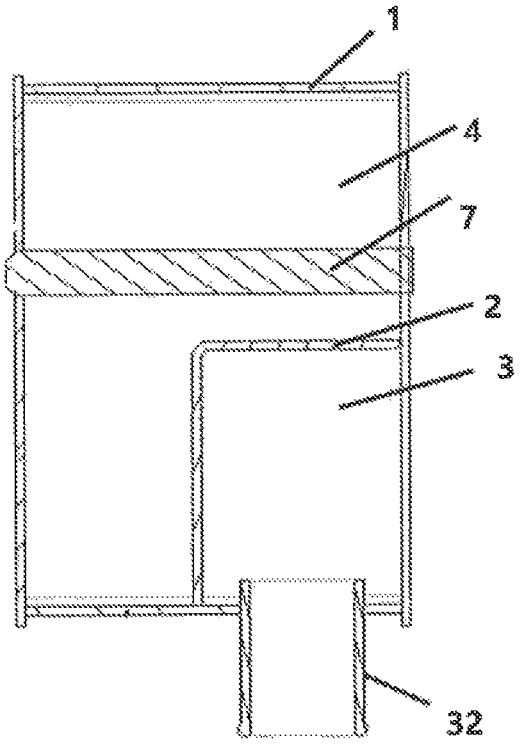
FIG. 9 is a cross-sectional plan view of the tank as shown in FIG. 2 taken along line D-D.

As an example, the embodiment shown in FIGS. 1-9 is first described, in which the exhaust tank 3 is integrated into the expansion tank 4 to form a tank 100 used in the engine cooling system. FIGS. 1-2 show external perspective views of the tank 100. FIGS. 3-9 show perspective and/or plan cross-sectional views taken along lines A-A, B-B, C-C, D-D in FIG. 2, so as to better show the internal structure of the tank 100. The tank 100 includes a housing 1, a partition 2, and a guiding tube 5. The partition separates the internal space of the housing 1 into an exhaust tank 3 and an expansion tank 4, as shown in FIGS. 1-9. The exhaust tank 3 includes a first connecting pipe 31 and a second connecting pipe 32. The first connecting pipe 31 is in fluid connection to an engine cylinder jacket 200 of the engine cooling system to introduce coolant into the exhaust tank 3, and the second connecting pipe 32 is in fluid connection with a heat exchanger 400 of the engine cooling system to discharge the coolant into the heat exchanger 400. The coolant enters the exhaust tank 3 via the first connecting pipe 31, and during the flow in the exhaust tank 3, part of the entrained gas in the coolant escapes from the coolant and is discharged via the guiding tube 5. As shown in FIGS. 4-5, the lower end of the guiding tube 5 opens into the exhaust tank 3, and the upper end of the guiding tube is disposed in the expansion tank 4 to guide the gas escaped from the coolant in the exhaust tank 3 to the expansion tank 4. Since the gas contains coolant molecules, it can be condensed back into a coolant after entering into the expansion tank, thereby the coolant is recovered and contamination of the atmosphere is avoided. Like a common expansion tank, the expansion tank 4 includes a third connecting pipe 41 in fluid connection to the engine cooling system for receiving or replenishing the coolant of the cooling system. In addition, as shown in FIG. 11, a connection pipe 401 is also provided between the heat exchanger, e.g. the right tank of the heat exchanger, and the expansion tank 4, for discharging the gas in the heat exchanger to the expansion tank 4. In this way, gas is collected in the expansion tank 4, and is condensed into coolant for being recovered, or is discharged to the environment through are exhaust device (e.g. a cover of the expansion tank) of the expansion tank when pressure in the expansion tank 4 is excessive.

As an example, in the embodiment of FIGS. 1-9, the partition is an L-shaped plate, which separates the interior of the housing 1 into two chambers that are sealed from each other, namely the expansion tank 4 and the exhaust tank 3. A horizontal arm 21 of the L-shaped partition is connected to a side wall of the housing 1, and a vertical arm 22 of the partition 2 is connected to a bottom wall of the housing 1, thereby a closed exhaust tank 3 is formed. However, it will be understood by those skilled in the art that partitions of various shapes can be employed as long as they divide the tank into the expansion tank 4 and the exhaust tank 3 and the gas in the exhaust tank 3 can be discharged to the expansion tank 4 through the guiding tube. Optionally, the exhaust tank 3 is located below the expansion tank 4 and the first connecting pipe 31 is disposed on the side wall of the housing 1 to facilitate filling of the coolant into the exhaust tank 3; the second connecting pipe 32 is disposed on the bottom wall 11 of the housing 1 to completely discharge the coolant. It will be understood by those skilled in the art that the exhaust tank and the expansion tank can also be arranged side by side horizontally, and the guiding tube can be disposed at upper portions of the exhaust tank and the expansion tank, so that gas in the exhaust tank can be discharged into the expansion tank.

The illustrated guiding tube 5 is a vertical pipe to discharge the gas more effectively. As an example, the first end, i.e. the lower end of the guiding tube 5 is connected to the horizontal arm 21 of the partition 2, and a gas outlet 23 is formed in the horizontal arm 21, the gas outlet 23 being communicated with the lower end of the guiding tube 5. In this way, the gas in the exhaust tank 3 can be vent through the guiding tube 5 to the utmost extent. The second end, e.g. the upper end of the guiding tube extends into the expansion tank 4 and above the level of the coolant. Alternatively, the lower end of the guiding tube 5 as a vertical pipe may also extend into the exhaust tank 3 but above the level of the coolant in the exhaust tank 3. It will be understood by those skilled in the art that the guiding tube 5 can also be inclined or even horizontal, as long as the gas in the exhaust tank 3 can be discharged to the expansion tank 4.

As shown in FIGS. 3-9, as an example, the exhaust tank 3 is formed at a lower portion of the housing 1, and the bottom wall 11 of the exhaust tank 3 constitutes the bottom wall of the housing 1. The bottom wall 11 comprises a protrusion 111 protruding toward an inner side of the exhaust tank 3 to buffer the flow of the coolant in the exhaust tank 3. Firstly, the protrusion 111 is provided to collide with the coolant. For example, the coolant from the first connecting pipe 31 may impinge on the protrusion 111, so that the bubbles in the coolant are easily broken, which facilitate escape of the gas. Secondly, the coolant in the exhaust tank 3 passes by the protrusion 111 in the process of flowing from the first connecting pipe 31 to the second connecting pipe 32, which blocks the flow of the coolant and reduces the flow rate thereof. At a lower flow rate of the coolant, more gas may escape therefrom.

As an example, in order to further lower the temperature of the coolant and reduce the thermal stress impact to the heat exchanger, an auxiliary cooling pipe 6 may be arranged on the exhaust tank. Specifically, as shown in FIG. 3, the protrusion 111 includes two side walls 112 extending from the bottom wall 11 toward the inner side of the exhaust tank 3, and a top wall 113 connecting the two side walls 112. The two side walls 112 and the top wall 113 define a space outside the tank 100 in which the least one auxiliary cooling pipe 6 is disposed. Two ends of each of the auxiliary cooling pipes 6 are respectively disposed on the two side walls 112 and opening into the exhaust tank 3. Therefore, the coolant can also flow from the first connecting pipe 31 to the second connecting pipe 32 via the auxiliary cooling pipes 6. Since the auxiliary cooling pipes 6 are in full contact with the air, heat dissipation can be improved and the temperature of the coolant can be lowered.

As shown in FIGS. 3-9, at least one reinforcing support 7 is provided vertically and/or transversally in the tank 100 between two opposed walls of the housing to support the walls of the housing and increase the strength of the tank.

In the technical solutions described above, the exhaust tank 3 and the expansion tank 4 are integrated into one tank, so that the cooling system can be installed easily, and the gas in the exhaust tank can be exported to the expansion tank conveniently, saving extra conveying pipelines. The one tank may for example be arranged in a conventional position for an expansion tank, for example above the heat exchanger.

However, those skilled in the art would appreciate that the exhaust tank does not have to be integrated into the expansion tank. Description to an embodiment in which the exhaust tank 3' is provided as a separate tank in the engine cooling system will be detailed below with reference to FIG. 10. The exhaust tank 3' may, for example, be placed on a liquid tank of the heat exchanger to facilitate connection with the liquid tank of the heat exchanger.

Figure 10:
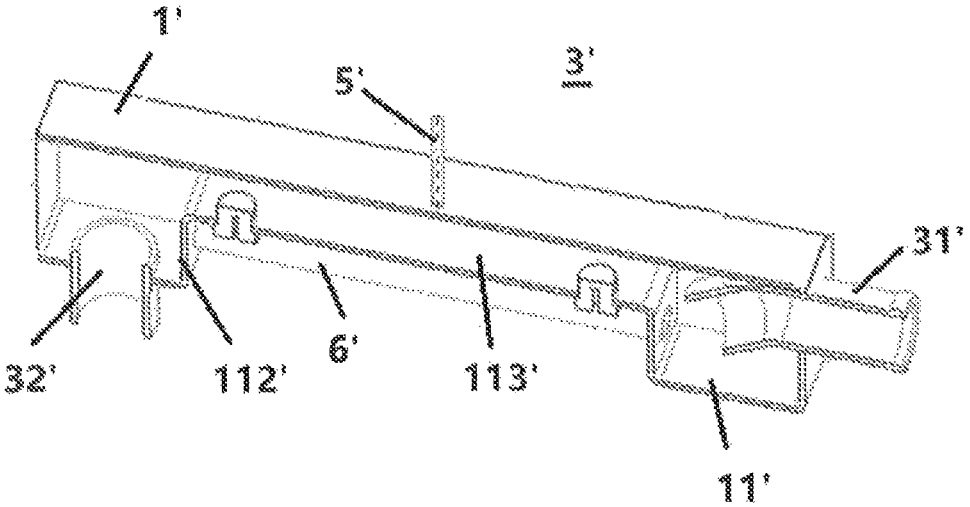
FIG. 10 is a cross-sectional perspective view of an exhaust tank according to an exemplary embodiment in the present invention.

Similar to the first embodiment shown in FIGS. 1-9, the structure of the exhaust tank 3' is substantially the same as that of the exhaust tank 3, thus this embodiment is just schematically illustrated in FIG. 10, which indicates the exhaust tank 3' as a separate tank. The exhaust tank 3' comprises a separate casing 1', and the coolant flows through a chamber defined by the casing 1'. The exhaust tank 3' further includes a first connecting pipe 31', a second connecting pipe 32', and a guiding tube 5' provided on the casing. The first connecting pipe 31' is adapted to be fluidly connected to an engine cylinder jacket 200 of the engine cooling system to introduce coolant into the exhaust tank 3', and the second connecting pipe 32' is adapted to be fluidly connected to the heat exchanger 400 of the engine cooling system to discharge the coolant into the heat exchanger 400. One end of the guiding tube 5' opens into the exhaust tank 3', and the other end of the guiding tube is connected directly or indirectly to the expansion tank of the engine cooling system to guide the gas escaped from the coolant in the exhaust tank to the expansion tank. The bottom wall 11' of the exhaust tank 3' also includes a protrusion protruding toward an inner side of the exhaust tank and including two side walls 112' and a top wall 113', the structure and function of which are the same as those described in the first embodiment shown in FIGS. 1-9, and will not be repeated here.

The present invention also relates to an engine cooling system, which includes the exhaust tank 3' or the tank 100 comprising the exhaust tank 3 as described above.

Further, the present invention also relates to a work machine comprising the engine cooling system as described above, whereby enables better heat dissipation of the engine cylinder of the work machine during operation, improves efficiency of the engine, and prolongs the service life of the engine.

INDUSTRIAL APPLICABILITY

Operation of the exhaust tank according to the present invention will be described below. When the engine is in operation, as an example, the coolant is pumped into the engine cylinder jacket 200 to exchange heat with the high-temperature engine cylinder, and the temperature of the coolant rises. As shown in FIGS. 1-2, the high-temperature coolant is injected into the exhaust tank 3 via the first connecting pipe 31. As shown in FIG. 3, the injected coolant collides with the side walls 112 or the top wall 113 of the protrusion 111, so that the gas bubbles therein are broken so that gas escapes from the coolant. One portion of the coolant flows over the top wall 113 to the second connecting pipe 32, and the flow is slowed down due to blocking by the protrusion 111, so as to facilitate escape of the gas. The other portion of the coolant flows through the auxiliary cooling pipes 6 to the second connecting pipe 32. Since the auxiliary cooling pipes 6 are located outside the tank and in contact with the air, the coolant can be further cooled. Thereafter, the coolant flows out of the exhaust tank 3 through the second connecting pipe 32, and enters into, for example, the right tank of the heat exchanger 400, as shown in FIG. 11, and then the coolant flows through the heat exchanger, where sufficient heat dissipation and cooling are performed. The cooled liquid flows to the inlet of the pump 300 through, for example, the left tank of the heat exchanger 400, and is circulated back to the engine cylinder jacket 200 under the action of the pump 300. Separation of the gas from the coolant is also beneficial to the operation of the coolant pump, by avoiding cavitation in the pump and preventing the pumping efficiency from being affected.

The gas in the exhaust tank 3 is vented by the guiding tube 5 into the expansion tank 4. The vented gas is condensed into coolant for being recovered, due to relatively low temperature in the expansion tank.

The exhaust tank is disposed in the cooling system and participates in each cycle of the coolant. Therefore, in every cycle of the coolant, the gas therein is separated in the exhaust tank, so that the gas in the coolant becomes less and less and coolant is purged.

Owing to the presence of the expansion tank 4, the coolant in the cooling system may overflow into the expansion tank when it is in a too high temperature to expand, and the cooling system can be replenished by the coolant from the expansion tank when the volume of coolant in not enough, thereby achieving effective operation of the cooling system.

For the embodiment in which the exhaust tank 3' is provided in the engine cooling system as a separated tank from the expansion tank, the operation thereof is substantially the same as the above, and will not be repeated here.

In the present invention, the exhaust tank provided between the engine cylinder jacket and the heat exchanger enables the gas in the coolant to be separated before entering into the heat exchanger, which reduces the impact to the heat exchanger by the entrained gas in the coolant, and avoids affecting the heat dissipation. Further, the exhaust tank may be integrated into the expansion tank of the engine cooling system, which may reduce the number of the components and facilitate installation, transportation, storage, and the like. Still further, by providing the exhaust tank in a circulation path of the engine cooling system, the coolant is separated from gas repeatedly, so that the gas in the coolant becomes less and less, thus the coolant is purged. Still further, by providing a protrusion in the exhaust tank, the flow rate of the coolant is slowed down, so that the gas is separated from the coolant more effectively. Furthermore, the temperature of the coolant is lowered by an auxiliary cooling pipe outside the exhaust tank, which promotes heat exchange of the coolant and reduces the thermal stress impact of the coolant on the heat exchanger.

The exhaust tank and the engine cooling system according to the present invention can be applied to various work machines (such as bulldozers, loaders, excavators, etc.), but are not limited thereto, since obviously it can be used in any cases where an engine cooling system is required, and can bring beneficial effects of separating the gas in the coolant, reducing thermal impact, and improving heat dissipation performance.

Various modifications and variations can be made by those skilled in the art to the embodiments disclosed above without departing from the scope or spirit of the invention. According to the practice of the invention disclosed in the specification, other embodiments of the invention are obvious to those skilled in the art. The specification and the examples disclosed therein shall be considered as illustrative only, and the real scope of the invention shall be specified by the appended claims and their equivalents.

The invention claimed is:

1. A tank for an engine cooling system, comprising:

a housing;

a partition dividing the housing into an exhaust tank and an expansion tank sealed from each other, wherein the exhaust tank comprises:

a first connecting pipe adapted to be fluidly connected to an engine cylinder jacket of the engine cooling system to introduce a coolant into the exhaust tank, a second connecting pipe adapted to be fluidly connected to a heat exchanger of the engine cooling system to discharge the coolant into the heat exchanger, and a bottom wall having a protrusion that protrudes toward an inner side of the exhaust tank, wherein the protrusion comprises:

two side walls extending from the bottom wall toward the inner side of the exhaust tank; and a top wall connecting the two side walls;

wherein the expansion tank comprises a third connecting pipe adapted to be fluidly connected to the engine cooling system;

the tank further comprising:

a guiding tube that has a first end in communication with the exhaust tank and a second end arranged in the expansion tank, so that gas contained in the coolant flowing through the exhaust tank is guided into the expansion tank through the guiding tube; and at least one auxiliary cooling pipe disposed outside the housing, each auxiliary cooling pipe having two ends that are respectively disposed on the two side walls and open into the exhaust tank.

2. The tank according to claim 1, wherein the partition is an L-shaped plate with a horizontal arm connected to a side wall of the housing and a vertical arm connected to a bottom wall of the housing.

3. The tank according to claim 2, wherein a gas outlet is formed in the horizontal arm, and the first end of the guiding tube is connected to the horizontal arm and communicated with the gas outlet.

4. The tank according to claim 1, wherein the first connecting pipe is disposed on a side wall of the housing, and the second connecting pipe is disposed on a bottom wall of the housing.

5. The tank according to claim 1, further comprising:

at least one reinforcing support each supporting between two opposed walls of the housing.

6. An engine cooling system, comprising:

an engine cylinder jacket;

a pump for pumping coolant through the engine cylinder jacket;

the tank according to claim 1; and a heat exchanger, wherein the pump circulates the coolant through the engine cylinder jacket, the tank and the heat exchanger.

7. A work machine, comprising the engine cooling system according to claim 6.

8. An exhaust tank for an engine cooling system, comprising:

a casing through which coolant flows;

a first connecting pipe disposed on the casing and adapted to be fluidly connected to an engine cylinder jacket of the engine cooling system to introduce the coolant into the exhaust tank;

a second connecting pipe disposed on the casing and adapted to be fluidly connected to a heat exchanger of the engine cooling system to discharge the coolant into the heat exchanger;

a guiding tube that has a first end in communication with the exhaust tank and a second end adapted to be connected to an expansion tank of the engine cooling system, so that gas contained in the coolant flowing through the exhaust tank is guided into the expansion tank through the guiding tube;

a bottom wall having a protrusion that protrudes toward an inner side of the exhaust tank, wherein the protrusion comprises:

two side walls extending from the bottom wall toward the inner side of the exhaust tank; and a top wall connecting the two side walls; and at least one auxiliary cooling pipe disposed outside the casing, each auxiliary cooling pipe having two ends that are respectively disposed on the two side walls and open into the exhaust tank.

9. An engine cooling system, comprising:

an engine cylinder jacket;

a pump for pumping coolant through the engine cylinder jacket;

an exhaust tank according to claim 8;

an expansion tank fluidly connected to the engine cooling system; and a heat exchanger, wherein the pump circulates the coolant through the engine cylinder jacket, the exhaust tank and the heat exchanger.

10. The engine cooling system according to claim 9, wherein the exhaust tank and the expansion tank are separate components.

11. The engine cooling system according to claim 9, wherein the exhaust tank is integrated with the expansion tank.

12. A tank for an engine cooling system, comprising:

a housing;

a partition dividing the housing into an exhaust tank and an expansion tank sealed from each other, the partition an L-shaped plate with a horizontal arm connected to a side wall of the housing and a vertical arm connected to a bottom wall of the housing, wherein the exhaust tank comprises:

a first connecting pipe adapted to be fluidly connected to an engine cylinder jacket of the engine cooling system to introduce a coolant into the exhaust tank, and a second connecting pipe adapted to be fluidly connected to a heat exchanger of the engine cooling system to discharge the coolant into the heat exchanger, wherein the expansion tank comprises a third connecting pipe adapted to be fluidly connected to the engine cooling system;

the tank further comprising:

a guiding tube that has a first end in communication with the exhaust tank and a second end arranged in the expansion tank, so that gas contained in the coolant flowing through the exhaust tank is guided into the expansion tank through the guiding tube.

13. A tank according to claim 12, wherein a gas outlet is formed in the horizontal arm, and the first end of the guiding tube is connected to the horizontal arm and communicated with the gas outlet.

* * * * *